United States Patent [19]

Knapp et al.

[11] Patent Number: 4,804,807

[45] Date of Patent: Feb. 14, 1989

[54] TWO COMPONENT OPERATING HANDLE FOR A PRIMARY CIRCUIT BREAKER

[75] Inventors: Todd K. Knapp, Waukesha; Ronny D. Jergenson, Hartland, both of Wis.

[73] Assignee: RTE Corporation, Brookfield, Wis.

[21] Appl. No.: 103,076

[22] Filed: Sep. 30, 1987

[51] Int. Cl.[4] ..... H01H 00/00

[52] U.S. Cl. ..... 200/331; 200/17 R; 337/245; 439/477

[58] Field of Search ..... 81/3.8, 53.1; 200/329–332, 334, 335, 338, 48 R, 17 R, 16 C, 144 R, 144 B, 48 KB, 48 V, 320, 321, 325; 337/178, 171, 202, 204, 207, 186, 245; 335/190; 361/331, 37; 174/139; 294/19.1; 439/476, 477, 480, 483, 484

[56] References Cited

U.S. PATENT DOCUMENTS

| | | | |
|---|---|---|---|
| 1,633,979 | 6/1927 | Crabbs | 200/325 |
| 1,925,624 | 9/1933 | Boll | 337/207 X |
| 4,268,811 | 5/1981 | Evans et al. | 337/169 X |
| 4,435,690 | 3/1984 | Link et al. | 361/37 X |
| 4,480,244 | 10/1984 | Manning | 337/171 |
| 4,636,764 | 1/1987 | Mee et al. | 337/169 |
| 4,737,878 | 4/1988 | Mikulecky | 361/37 |

*Primary Examiner*—J. R. Scott

*Attorney, Agent, or Firm*—Eddie E. Scott; Nelson A. Blish; Alan R. Thiele

[57] ABSTRACT

A two component operating handle for opening and closing an electrical switch by a hook stick, the handle including a rigid portion mounted on the operating shaft of the electrical switch and a flexible portion mounted on the outer end of the rigid portion. The flexible portion including a pair of extensions extending outwardly to form an enclosed hook stick opening with the ends of the extensions terminating at a slot at the outer end of the handle so that the hook stick will be released from the opening on bending of one or both of the extensions to open the slot when the rigid portion of the handle engages a fixed stop.

5 Claims, 3 Drawing Sheets

TWO COMPONENT OPERATING HANDLE FOR A PRIMARY CIRCUIT BREAKER

BACKGROUND OF THE INVENTION

In manually actuated circuit breakers or switches of the type shown in Mikulecky U.S. Pat. No. 4,737,878, which is incorporated herein by reference and U.S. Pat. No. 4,435,690 both commonly owned, an operating handle is used to open and close the switch by inserting a hook stick into an opening in the end of the operating handle. The hook stick is approximately five to six feet long and the operator pushes or pulls on the stick to open and close the switch. The operating handle is made of a rigid plastic material and, if pushed or pulled with too much force at the end of the stroke, will break requiring replacement.

SUMMARY OF THE INVENTION

The present invention relates to an operating handle for an electric switch which can be operated by a hook stick and which can be automatically released from the hook stick if too much force is exerted by the operator on the operating handle at the end of the opening or closing stroke.

A principal feature of the invention is the provision of a flexible portion on one end of the operating handle for an electric switch which allows for release of the hook stick when the operating handle reaches the end of the opening or closing stroke.

Other principal features and advantages of the invention will become apparent to those skilled in the art upon reading the following detailed description, claims and drawings.

DETAILED DESCRIPTION OF THE INVENTION

Figure 2:
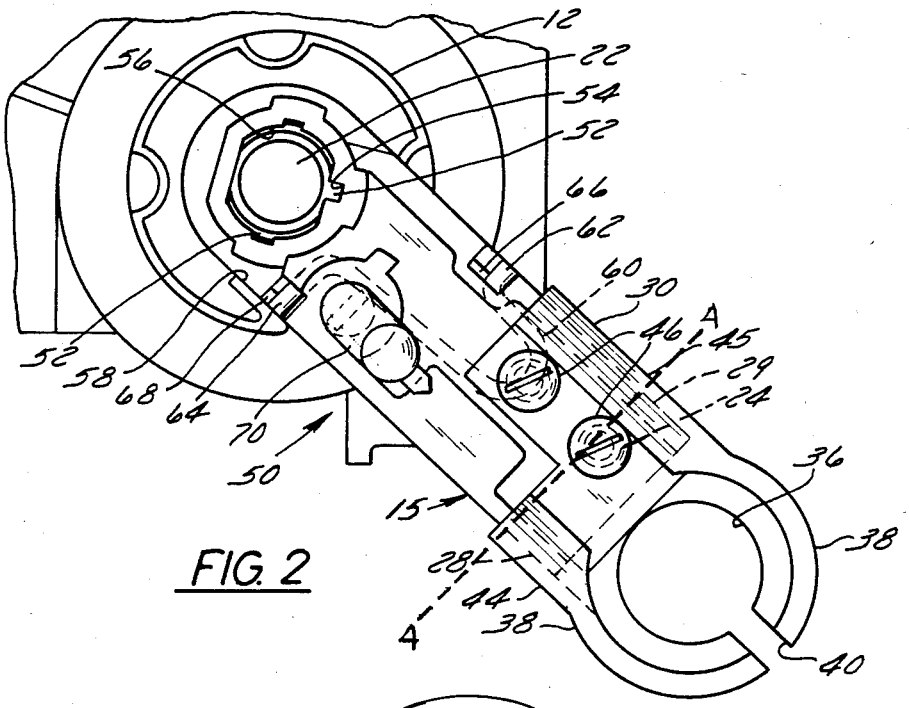
FIG. 2 is a side view and elevation of the operating handle.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 1:
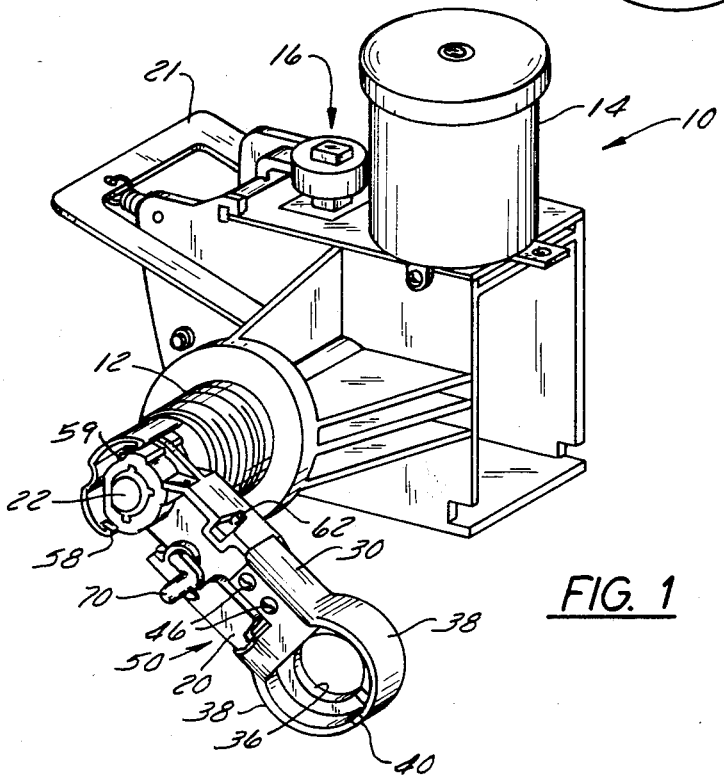
FIG. 1 is a perspective view of a primary circuit breaker showing the operating handle according to the invention mounted on the operating shaft.
Figures 3, 4:
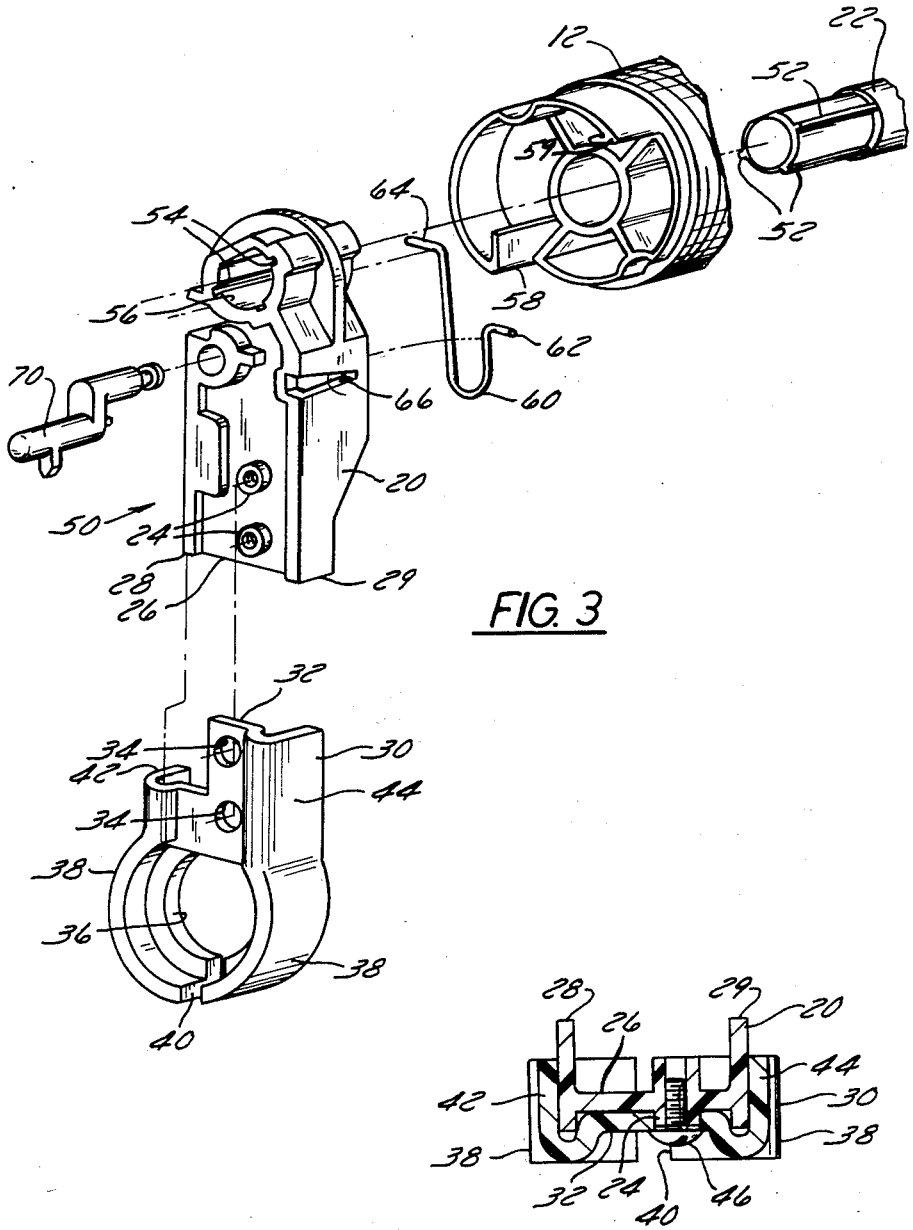
FIG. 3 is an exploded perspective view of the operating handle.
FIG. 4 is a view taken on line 4—4 of FIG. 2 showing the connection of the flexible portion to the rigid portion of the operating handle.
Figure 5:
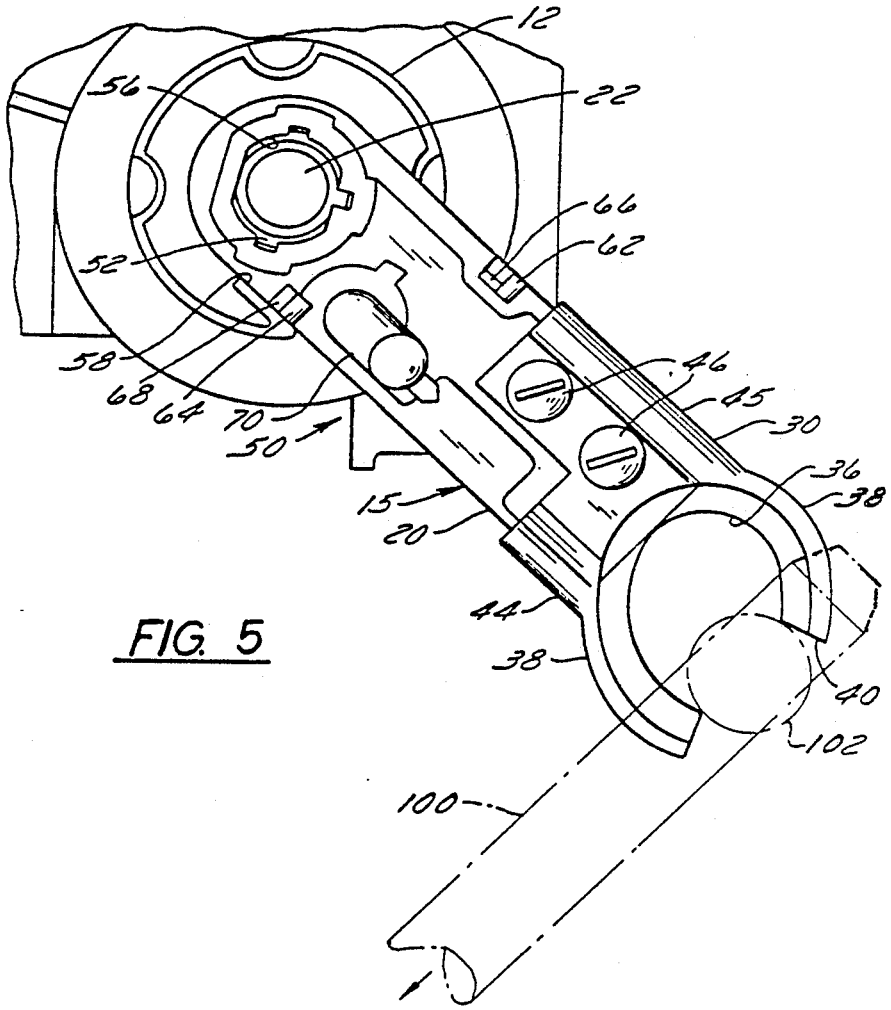
FIG. 5 is a view showing a hook stick being released from the flexible portion of the operating handle.

The primary circuit breaker or switch 10 of the type contemplated herein includes a frame or base 12 having an arc extinguishing assembly 14, a temperature responsive trip assembly 16 and a yoke 21 mounted on an operating shaft or a crank shaft 22 for opening and closing the circuit breaker. An operating handle 50 is mounted on the end of the shaft 22 and is pulled or pushed by a hook stick 100 (See FIG. 5) to open or close the circuit breaker. The hook stick 100 includes a boss 102 on the end for engaging the handle 50. The handle 50 is mounted on the end of the crank shaft 22 and fixed with respect thereto by means of splines 52 which are provided on the end of the shaft 22 and which mate with grooves 54 provided in an opening 56 in the handle 50. The operating handle 50 is normally rotated into engagement with a fixed travel stop 58 provided on the frame 12 when closing the circuit breaker and into engagement with fixed travel stop 59 when opening or resetting the circuit breaker. If the circuit breaker is to be set for emergency overload operation, the operating handle 50 is prevented from moving into engagement with the fixed stop 58 by means of a spring 60 (See FIGS. 1 and 3) located in the operating handle 50.

In this regard the spring 60 is in the form of a "U" having one end 62 seated in a groove 66 in the operating handle 50 and the opposite end 64 positioned in an opening 68 on the opposite side of the operating handle 50. The spring 60 is moved between normal and operating positions by means of a cam lever 70 to change the amount of rotation of the operating handle.

In accordance with the present invention means is provided for preventing damage to the operating handle due to the exertion of excessive force when the operating handle is moved into engagement with fixed stops 58 and 59 by the hook stick 100. Such means is in the form of a two piece handle having a flexible section or portion 30 and a rigid section or portion 20. In this regard the rigid portion 20 is formed of a rigid plastic material in the same configuration as the shaft portion of the operating handle 50 in Mikulecky U.S. Pat. No. 4,737,878. A pair of threaded bosses 24 (see FIG. 3) are provided on the center section 26 of the portion 20 between flanges 28 and 29.

The flexible portion or section 30 is molded of a flexible, elastic plastic material such as the Hytrel material made by DuPont. The section 30 includes a planar center section 32 having a pair of openings 34 and a generally enclosed hook stick opening 36 formed by two outwardly extending extensions 38 which are spaced at their outer ends to form slot 40. The center section 36 and extensions 38 are strengthened by means of flanges 42 and 44 provided on the edges of section 35 and extension 38. The extensions 38 are shown as curved sections which form the enclosed opening 36 however the extensions can take on other forms depending on the shape of the boss 102 on the hook stick. The flexible portion 30 is mounted on the rigid portion 20 by aligning the threaded bosses 24 with the openings 34 in portion 30 and is then secured thereto by means of screws 46. The flanges 42 and 44 will mattingly engage the outside of the flanges 28 and 29, respectively, of the rigid portion 20 to provide greater stability to the flexible portion 30.

In operation, the boss 102 on the hook stick 100 is inserted into the opening 36 and the operating handle 50 is pushed or pulled (FIG. 5) to rotate shaft 22 and open or close the circuit breaker. When the rigid portion 20 of the handle 50 engages one of the fixed stops 58 or 59, the ends of the extensions 38 will give or bend opening the slot 40 and allowing the boss 102 on the hook stick 100 to slide out of the opening 36.

The embodiment of the invention is which an exclusive or privilege is claimed, as defined as follows:

1. A hook stick operated handle for an electrical switch having an operating shaft, said handle comprising a rigid portion adapted to be mounted on the operating shaft of the electrical switch, and a flexible portion including an inner end mounted on and forming an extension of said rigid portion, said flexible portion including an outer end with a generally enclosed opening for receiving a hook stick, and a slot in said outer end, so that, when the handle is mounted on the operating shaft, the hook stick can be released from the opening in the outer end of said flexible portion on bending of the extensions and opening of the slot by the pulling of the hook stick through the slot.

2. A hook operating handle for an electrical switch having an operating shaft and fixed travel stops for the handle, said handle including a rigid portion adapted to be mounted on the operating shaft and engageable with the fixed travel stops, and a flexible portion mounted on said rigid section, said flexible portion including a pair of extensions having ends spaced apart and extending radially outwardly from where the rigid portion is adapted to be mounted on the operating shaft and forming a hook stick receiving opening, said extensions being sufficiently rigid to transfer the opening and closing motion of the hook stick to the operating shaft and sufficiently flexible to allow the hook stick to bend one or both of the extensions when the rigid portion engages one of the fixed travel stops.

3. The operating handle according to claim 2 wherein said extensions are curved to form a circular opening.

4. The operating handle according to claim 2 wherein saaid rigid portion includes a center section and flange mounted on each edge of said center section, and said flexible portion includes a center section and a flange on each edge for matingly engaging said flanges of said rigid section.

5. A hook stick operating handle for an electric switch having an operating shaft and fixed travel stops for the handle, said handle including a rigid portion adapted to be mounted on the operating shaft, said rigid portion including a center section and a flange one each edge of said center section, and a flexible portion mounted on said rigid portion, said flexible portion including a pair of flanges for matingly engaging said flanges of said rigid portion and a pair of extensions having ends spaced apart and extending outwardly from said rigid portion and forming a generally enclosed hook stick opening, the ends of said extensions forming a slot at the outer end of said handle so that a hook stick will be released from said handle on bending of the extensions on engagement of said handle with one of the fixed travel stops.

* * * * *